US011306544B2

(12) United States Patent
Al-Helal et al.

(10) Patent No.: US 11,306,544 B2
(45) Date of Patent: Apr. 19, 2022

(54) WELL PAD CONSTRUCTION SYSTEM AND METHODS

(71) Applicant: Saudi Arabian Oil Company, Dhahran (SA)

(72) Inventors: Zakariya Saleh Al-Helal, Alhasa (SA); Carlos Ernesto Acero, Dhahran (SA); Ali Muhammed Al-Ali, Alhasa (SA); Sami Ali Al-Ghamdi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 80 days.

(21) Appl. No.: 16/848,324

(22) Filed: Apr. 14, 2020

(65) Prior Publication Data

US 2021/0317708 A1 Oct. 14, 2021

(51) Int. Cl.

| | |
|---|---|
| ***E21B 15/00*** | (2006.01) |
| ***E21B 33/037*** | (2006.01) |
| *E02D 17/02* | (2006.01) |
| *E21B 33/14* | (2006.01) |

(52) U.S. Cl.

CPC ..... *E21B 15/006* (2013.01); *E21B 33/037* (2013.01); *E02D 17/02* (2013.01); *E21B 33/14* (2013.01)

(58) Field of Classification Search

CPC ..... E21B 15/00; E21B 15/006; E21B 33/02; E21B 33/03; E21B 33/14; E02D 17/00; E02D 17/02

See application file for complete search history.

(56) References Cited

U.S. PATENT DOCUMENTS 4,335,740 A * 6/1982 Boley ..... E02D 29/12 137/364
5,112,161 A 5/1992 Trevisani
5,249,892 A 10/1993 Fox et al.
5,863,476 A 1/1999 Wier (Continued)

FOREIGN PATENT DOCUMENTS

AU 2019253896 A1 * 5/2020
WO WO-2011/123918 A1 10/2011

(Continued)

OTHER PUBLICATIONS

Kelly, D., and Gil, J., Monitoring HEIC using Landpac CIR and CIS Technologies, International Symposium on Ground Improvement IS-GI Brussels, 10 pages (May 2012), <https://www.researchgate.net/profile/Dermot_Kelly2/publication/304012852_Monitoring_HEIC_using_Landpac_CIR_and_CIS_Technologies/links/5a9ed6900f7e9badd99e77eb/Monitoring-HEIC-using-Landpac-CIR-and-CIS-Technologies.pdf?origin=publication_detail>.

(Continued)

*Primary Examiner* — Tara Schimpf
(74) *Attorney, Agent, or Firm* — Choate, Hall & Stewart LLP; Charles E. Lyon; Peter A. Flynn

(57) ABSTRACT

A well pad construction system includes a construction area, surface compaction equipment to compact the construction area, an excavator disposed at the construction area and movable to generate an excavated area, a cellar disposed in the excavated area, controlled low-strength material (CLSM), and backfill equipment disposed around the excavated area. The backfill equipment is moveable over the construction area to pour CLSM into a gap between the cellar and surrounding medium in the excavated area for holding the cellar in place and providing a firm well pad from which a rig may operate.

26 Claims, 8 Drawing Sheets

(56) References Cited

U.S. PATENT DOCUMENTS

| | | | | |
|---|---|---|---|---|
| 7,987,904 | B1 * | 8/2011 | Rose | E21B 43/0122 166/96.1 |
| 8,752,637 | B1 * | 6/2014 | Childers | E21B 33/03 166/380 |
| 9,915,051 | B2 | 3/2018 | Niroumand | |
| 10,202,816 | B1 * | 2/2019 | Stierwalt | E21B 33/03 |
| 10,253,472 | B2 | 4/2019 | Garzon et al. | |
| 2014/0102691 | A1 * | 4/2014 | Gibson | E21D 5/016 166/244.1 |
| 2018/0002882 | A1 | 1/2018 | Stromsoe | |
| 2019/0040705 | A1 | 2/2019 | Stierwalt | |
| 2021/0180424 | A1 * | 6/2021 | S↑ther et al. | E21B 33/035 |

FOREIGN PATENT DOCUMENTS

| | | | |
|---|---|---|---|
| WO | WO-2017/048941 | A1 | 3/2017 |
| WO | WO-2021/209798 | A1 | 10/2021 |

OTHER PUBLICATIONS

Kelly, D.B., Deep In-Situ Ground Improvement Using High Energy Impact Compaction (HEIC) Technology, 7 pages (2000).

White, D.J. et al., Assessing Soil Stiffness of Stabilized Pavement Foundations, Transporation Research Record: Journal of the Transporation Research Board, 99-109 (2013).

International Search Report for PCT/IB2020/054707, 5 pages (dated Dec. 21, 2020).

Written Opinion for PCT/IB2020/054707, 7 pages (dated Dec. 21, 2020).

* cited by examiner

WELL PAD CONSTRUCTION SYSTEM AND METHODS

FIELD

The subject matter described herein relates to systems, methods, and materials for preparing well pads to install drilling rigs and drill boreholes.

BACKGROUND

Current construction practices of well pads for drilling rigs in the oil and gas industry generally require excavating a construction area. After excavation, a steel or fiberglass cellar may be installed, for example, in the middle of the construction area. The rest of the construction area surrounding the cellar may then be backfilled by loose materials that are then compacted into layers of the loose materials. For a single well, the overall site may be 140 m×140 m in area. Currently construction activities may take, for example, about 10 days, to complete. Transportation and watering of backfill materials are also required for conventional layer-by-layer backfilling.

SUMMARY OF THE INVENTION

The present disclosed embodiments include systems, methods, and materials for constructing well pads using a well pad construction system.

In one aspect, the present invention is directed to a well pad construction system including: a construction area; an excavator disposed at the construction area; a cellar disposed within the excavated area; controlled low-strength material (CLSM); and backfill equipment disposed around the excavated area at the construction area. The excavator is moveable over the construction area to generate an excavated area. The backfill equipment is moveable to pour CLSM into a gap between the cellar and surrounding medium in the excavated area for holding the cellar in place.

In some embodiments, the system further includes a compactor disposed at the construction area. The compactor is moveable over the construction area. The compactor may include an impact roller for compacting the excavated area prior to excavation.

In some embodiments, the impact roller includes a non-cylindrical impact roller with three rounded lobes connected by three joints. Each rounded lobe includes from about 120° to about 180° of a cylinder.

In some embodiments, the compactor applies high energy impact compaction (HEIC) at the construction area.

In some embodiments, the CLSM includes water, cement, and fine aggregates.

In some embodiments, the CLSM includes byproduct materials.

In some embodiments, the expected maximum strength of the CLSM is about 8.3 MPa (1200 psi).

In some embodiments, the cellar is composed of at least one of steel, aluminum, concrete, reinforced concrete, fiberglass, and fiberglass-reinforced plastic.

In some embodiments, the cellar includes a shape of at least one of a cuboid, a box, a cylinder, a barrel, a bowl, and combinations thereof.

In some embodiments, the sides and bottom of the cellar include a crack-resistant material.

In some embodiments, the top and the bottom of the cellar are at least partially open.

In some embodiments, the system further includes: a drilling rig disposed longitudinally above the cellar; and a drill pipe disposed longitudinally below the drilling rig. The drill pipe passes through a top and a bottom of the cellar for drilling a borehole downward below the cellar.

In another aspect, the present invention is directed to a method of preparing a well pad including: identifying a construction area; compacting the construction area to generate a compacted medium within the construction area; excavating the compacted medium using an excavator; installing a cellar in the excavated area; and backfilling a gap between the cellar and surrounding medium with a backfill material. Compacting the construction area may use high energy impact compaction (HEIC). Excavating the compacted medium creates an excavated area within the compacted medium.

In some embodiments, the backfill material includes controlled low-strength material (CLSM).

In some embodiments, the gap between the cellar and the surrounding medium is up to about 0.5 m wide.

In some embodiments, the cellar is disposed near or at the center of the excavated area.

In some embodiments, installing the cellar in the excavated area includes using at least one of trucks, cranes, excavators, skid steers, and loaders.

In some embodiments, the system further includes installing at least one drilling rig at the construction area. The at least one drilling rig is disposed longitudinally above the cellar.

In some embodiments, preparing the well pad takes up to about 3 days.

In another aspect, the present invention is directed to a method of constructing a well pad including: identifying a construction area; applying a high weight on the construction area for at least one pass using a compactor or other compaction methods; excavating the construction area; installing a cellar in the construction area; and backfilling a gap between the cellar and surrounding media using controlled low-strength material (CLSM). The construction area includes at least one medium.

In some embodiments, the compactor uses high energy impact compaction (HEIC).

In another aspect, the present invention is directed to a drilling site including: a compacted medium including an excavated area; a cellar disposed within the excavated area; backfill material disposed between the cellar and the compacted medium; a drilling rig disposed longitudinally above the cellar; and a drill pipe disposed longitudinally below the drilling rig, the drill pipe passing through a top and a bottom of the cellar for drilling a borehole downward below the cellar.

In some embodiments, the backfill material includes controlled low-strength material (CLSM).

In some embodiments, the cellar includes at least one of a box shape, a cuboid shape, and a cylinder shape.

In some embodiments, a volume of excavation required for rig pad preparation is reduced by at least 80%.

In some embodiments, additional soil is not required for use as the backfill material.

In some embodiments, the backfill material consists of CLSM.

Throughout the description, where an apparatus, systems or embodiments are described as having, including, or comprising specific components, or where methods are described as having, including, or comprising specific steps, it is contemplated that, additionally, there are systems, apparatuses or embodiments of the present invention that consist essentially of, or consist of, the recited components, and that there are methods according to the present invention that consist essentially of, or consist of, the recited processing steps.

It should be understood that the order of steps or order for performing certain actions is immaterial as long as the invention remains operable. Moreover, two or more steps or actions may be conducted simultaneously.

The following description is for illustration and exemplification of the disclosure only, and is not intended to limit the invention to the specific embodiments described.

The mention herein of any publication, for example, in the Background section, is not an admission that the publication serves as prior art with respect to any of the present claims. The Background section is presented for purposes of clarity and is not meant as a description of prior art with respect to any claim.

BRIEF DESCRIPTION OF THE DRAWINGS

A full and enabling disclosure of the present disclosed embodiments, including the best mode thereof, directed to one of ordinary skill in the art, is set forth in the specification, which makes reference to the appended figures, in which.

DESCRIPTION OF CERTAIN EMBODIMENTS OF THE INVENTION

Figure 1:
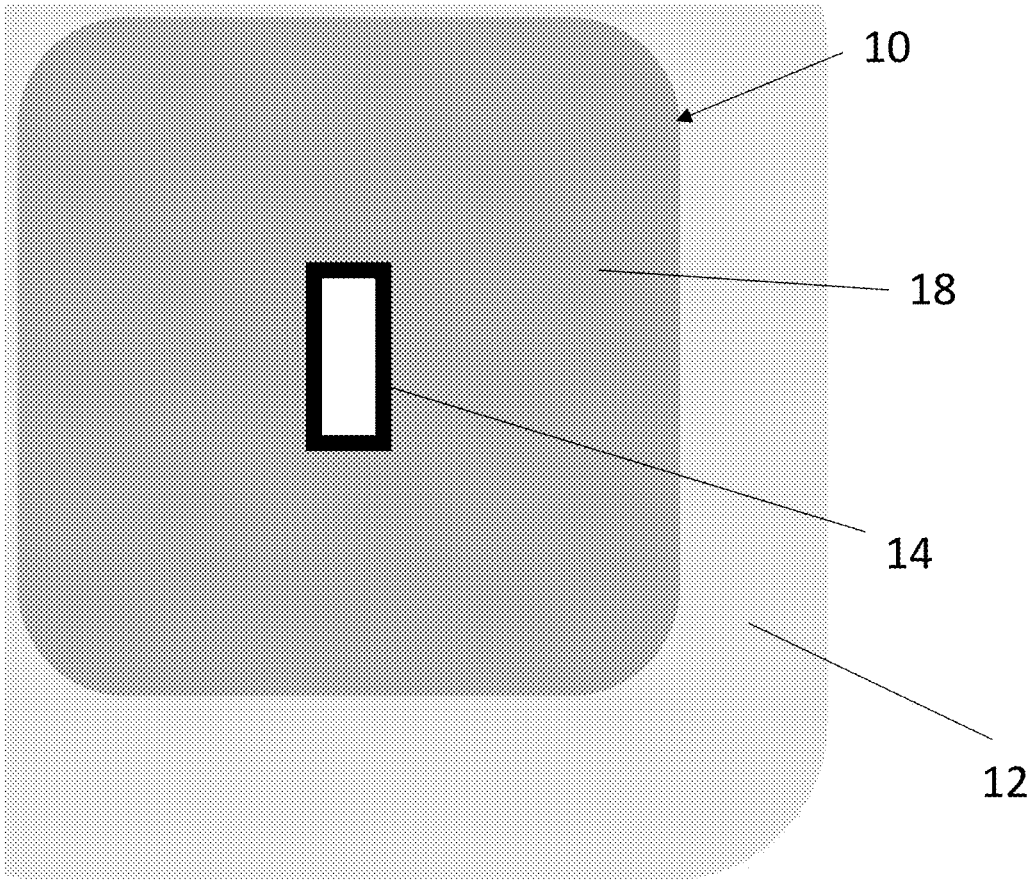
FIG. 1 illustrates a top view of an exemplary well pad.

Reference will now be made in detail to the present disclosed embodiments, one or more examples of which are illustrated in the accompanying drawings. The detailed description uses numerical and/or letter designations to refer to features in the drawings. Like or similar designations in the drawings and description have been used to refer to like or similar parts of the present embodiments.

The present embodiments are directed to improved systems, methods, and materials for preparing and constructing well pads for drilling operations in the oil and gas industry (and other applications such as for drilling water wells), by using a well pad construction system. The improved system and methods may reduce: 1) the time (for example, up to about 80%) for constructing well pads, 2) the volume (for example, by at least 80% and/or up to about 94%) of the excavation and/or construction area when compared to conventional methods, and 3) the required number of quality control tests, which may be beneficial for the environment and site safety. For example, compared with an exemplary method that may take 10 days, the present disclosed embodiments may take about 1 to about 3 days with up to about 94% reduction in the volume of excavation. The systems, methods, and materials may reduce the amount of materials (such as soil) that need to be transported to the site for backfilling, in an exemplary method. The system may use work crews, equipment (for example, trucks, cranes, loaders, compactors, excavators, skid steers, and/or combinations thereof), cellars, and backfill materials (preferably controlled low-strength material (CLSM)), to reduce the time and cost for the well pad construction. The methods may include processes of compacting, excavating, installing, and backfilling for well pad preparation and/or construction. The method may also be used for compaction in cases where water tables are present.

The present embodiments may include a compaction technique (for example, high energy impact compaction (HEIC)) to achieve the required compaction level (for example, 95% compaction or 95% maximum dry density using the modified Proctor test designated by ASTM D-1557). The present system and methods do not require watering for compaction, transportation of materials during construction (for example, during excavation or backfilling), or layer-by-layer compaction. The present disclosed embodiments also reduces: the space required for excavation and backfilling, the required backfill materials, dust, and traffic at the wellsite, and the number of quality control tests, thereby resulting in reduced cost and time for well pad construction. For example, a well pad construction using the present disclosed embodiments may be accomplished in up to about 3 days compared with about 10 days when using conventional systems, methods, and materials.

In some embodiments, the systems, methods, and materials may use HEIC for compaction (when compaction is required) and CLSM for backfilling to expedite the construction of the wellsite and achieve desired engineering properties with minimal disturbance to existing site conditions and surrounding areas. HEIC may be selected as an effective compaction method in terms of achieving the required compaction depth, the ease of use, and the ease of transportation to the construction site. To avoid cellar damage from compaction using HEIC, the step of compaction may be conducted before the steps of excavation and installation.

Figure 2:
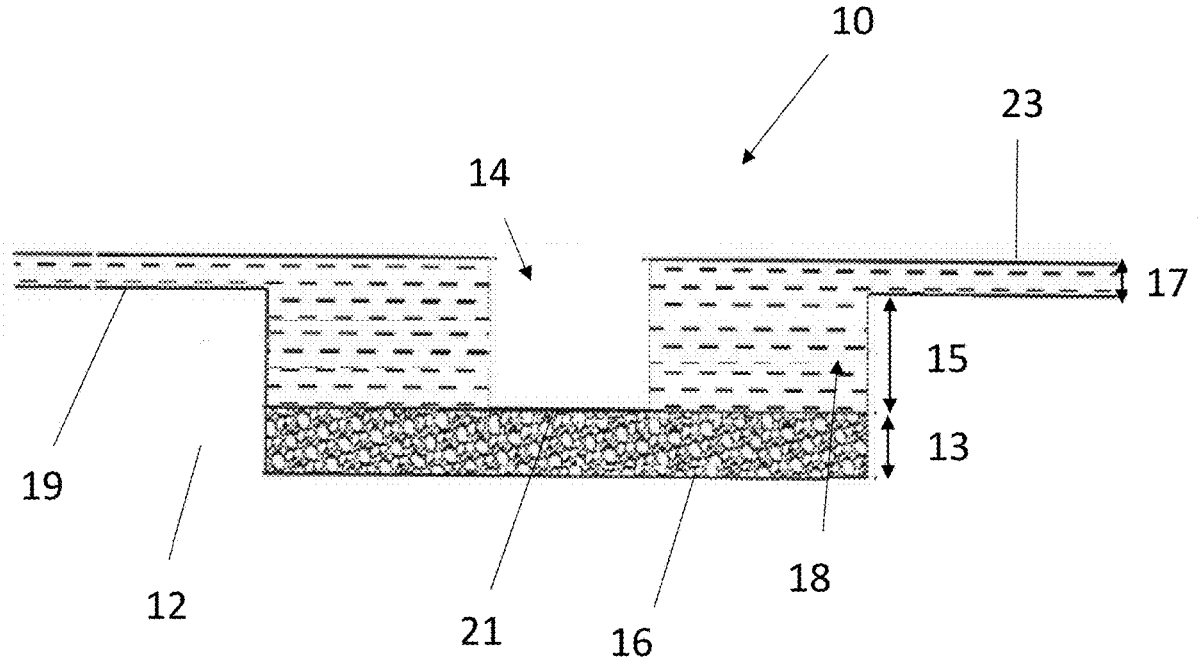
FIG. 2 illustrates a cross-section view of an exemplary well pad with an excavation for a cellar.

FIGS. 1-2 illustrate top and cross-section views of an exemplary well pad 10 formed within a medium 12. The exemplary well pad 10 may be excavated from the medium 12 and may include a periphery in the shape of a rectangle, prism, cube, and/or other shape. A bottom pad 16 may be disposed at the bottom of the exemplary well pad 10 and filled with loose backfill material (for example, dry compacted marl, or other materials) with a first depth 13. In some embodiments, the first depth 13 may be up to about 1.2 m. In some embodiments, the first depth 13 may be up to about 0.9 m. In some embodiments, the first depth 13 may be up to about 0.6 m. In some embodiments, the first depth 13 may be up to about 0.4 m. In some embodiments, the first depth 13 may be up to about 0.1 m. In one embodiment, the first depth 13 may be about 0.3 m. A cellar 14 may be disposed longitudinally above the bottom pad 16 within the exemplary well pad 10. The cellar 14 may be near or in the middle of the exemplary well pad 10 and may include a periphery in the shape of a rectangle, prism, cube, and/or other shape. A gap or a plurality of gaps 18 including space between the cellar 14 and surrounding medium (for example, medium 12) may be backfilled by layers of a second loose backfill material (for example, wet compacted marl or other materials) to hold the cellar 14 in place, and to provide a firm well pad for one or more rigs to stand on and operate from. The layers of the second loose backfill material may include a second depth 15. The second depth 15 may include the longitudinal distance between the bottom of the cellar 14 and ground surface 19. In some embodiments, the second depth 15 may be up to about 10 m. In some embodiments, the second depth 15 may be up to about 8 m. In some embodiments, the second depth 15 may be up to about 6 m. In some embodiments, the second depth 15 may be up to about 4 m. In one embodiment, the second depth 15 may be about 4.12 m. In some embodiments, the layers of the second loose backfill material 23 may be partially above ground surface 19 and may include a third depth 17. The third depth 17 may include the longitudinal distance between ground surface 19 and the top surface of the layers of the second loose backfill material 23. In some embodiments, the third depth 17 may be up to about 1 m. In some embodiments, the third depth 17 may be up to about 0.6 m. In some embodiments, the third depth 17 may be up to about 0.3 m. In some embodiments, the third depth 17 may be up to about 0.1 m. In one embodiment, the third depth 17 may be about 0.15 m. Both the gap 18 and the cellar 14 may include a shape of a cuboid, cylinder, bowl, and/or combinations thereof. In some embodiments of FIG. 2, the gap 18 may be at least partially wider or longer than the cellar 14.

In some embodiments of FIG. 2, the exemplary well pad 10 may be up to 25 m×25 m in area with a depth of up to about 4.27 m, and the cellar 14 may be about 3.96 m×about 6.71 m in area with a depth of up to about 4.27 m. For a single well operation, an overall exemplary wellsite may be up to 140 m×140 m in area. Each layer of the backfill may be up to about 0.2 m thick. In some embodiments of FIG. 2, the exemplary well pad 10 may be up to 50 m×50 m in area with a depth of up to about 6 m; the cellar 14 may be from about 5 m×up to about 10 m in area with a depth of up to about 6 m; the overall exemplary wellsite may be up to 200 m×200 m in area; and/or each layer of the backfill may be up to about 0.4 m thick. In some embodiments of FIG. 2, the exemplary well pad 10 may be up to 75 m×75 m in area with a depth of up to about up to 10 m; the cellar 14 may be from about 10 m×up to about 15 m in area with a depth of up to about 10 m; the overall exemplary wellsite may be up to 250 m×250 m in area; and/or each layer of the backfill may be up to about 0.6 m thick. In other embodiments of FIG. 2, the exemplary well pad 10 may include a length and a width that are each in a range from about 15 m to about 35 m with a depth of from about 3 m to about 7 m; the cellar 14 may include a length and a width that are each from about 2 m to about 8 m, with a depth from about 3 m to about 6 m; the overall wellsite may include lengths and widths from about 100 m to about 200 m; each layer of the backfill may from about 0.1 m to about 0.4 m thick. For quality control, the layers of the backfill material may need to be tested after compaction (for example, 4 tests per layer) and achieve the required compaction (for example, about 95% compaction). Using conventional methods, the well pad construction, including excavating the area, installing the cellar 14, backfilling, and compacting the area in layers, may take about 10 days to complete and may also need watering for each layer and sometimes transportation of materials for backfilling. A surface tolerance may be within about ±3 cm of the planned location elevation within 25 m of the wellhead and ±8 cm of planned location elevation throughout the rest of the location. Ramps (not shown) may be built on one or two sides of the excavation (for example, on either side of the cellar) to allow access for construction equipment.

Figure 3:
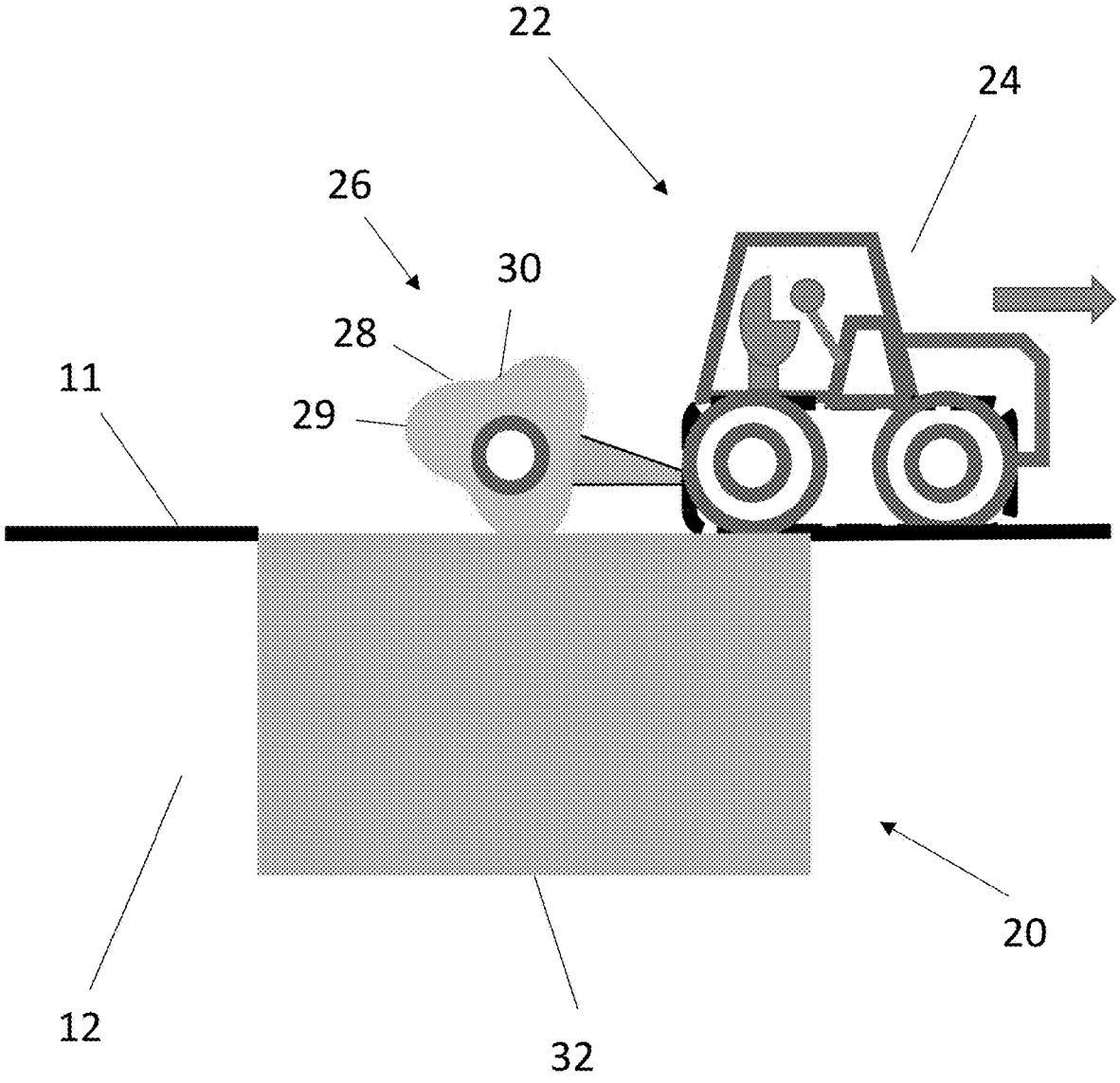
FIG. 3 illustrates a side view of compaction of a construction area, according to aspects of the present embodiments.

FIG. 3 illustrates a side view of compaction of a construction area, according to aspects of the present embodiments. A compactor 22 may drive or roll over a medium surface 11 to compact or consolidate a construction area 20 within the formation for preparing a compacted medium 32. The construction area 20 may include natural sand, reclaimed sand deposits, uncompacted and/or un-controlled variable clay fills, and may be up to about 4-5 m deep from the medium surface 11. In some embodiments, the construction area 20 may be from about 4.2 m to about 4.8 m deep, or from about 4.4 m to about 4.6 m deep, or from about 4.0 m to about 5.0 m deep, or from about 3.0 m to about 6.0 m deep. In one embodiment, the compacted medium 32 may be up to about 4.57 m deep. The compactor 22 may include a front end machine 24 (for example, a tractor, a loader, or a bulldozer) operatively coupled to a drum or an impact roller 26. The compactor 22 may include any compaction equipment (for example, equipment other than an impact roller 26) that can achieve the required compaction. The front end machine 24 may be operated electrically, hydraulically, or mechanically during compaction and may be driven over the construction area 20 one or multiple times. The typical weight of the impact roller 26 may be from about 9 to about 15 tons.

Referring to FIG. 3, in some embodiments, the impact roller 26 may include one or more cylindrical or non-cylindrical multisided (for example, three-sided, four-sided, or five-sided) drums or modules. In some embodiments, the impact roller 26 may include one or more polygonal (for example, triangular or equilateral, pentagonal, or octagonal) drums axially coupled together. The multisided or polygonal drums of the impact roller 26 may include lobes 28 and joints 30 (or contact lines), each lobe 28 including a rounded corner 29. The lobes 28 may be connected along joints 29 via welding, epoxy, brazing, fusion, additive manufacturing, and/or other methods. When the compactor 22 is driven over the medium surface 11, the impact roller 26 may rotate to raise and lower a weight from a height to the construction area 20 (that is, the rounded coner 29 of each lobe 28 may contact the medium surface 11 in turn), resulting in densification and high energy impact compaction of the medium 12. In the embodiment of FIG. 3, the impact roller 26 may be substantially triangular with three rounded lobes 28, each rounded lobe 28 spanning from about 120° to about 180° of a circle or cylinder. The compactor 22 may also include recording, measurement, and monitoring systems for detecting and measuring real-time responses from the medium 12 during compaction.

Referring still to FIG. 3, the effect (for example, depth) of compaction may vary with the characteristics (for example, component and moisture) of the construction area 20 and the specific energy input. For example, in some embodiments, the depth of compaction for natural marine sand and clay fill using HEIC may be up to about 4 m, about 5 m, about 6 m, and/or about 7 m depending on several factors which may include: the composition of the compaction media, the coarseness or fineness of the particles, the level of moisture in the compaction media, how loosely packed the media is initially, as well as other factors. In some embodiments, the depth of compaction for natural marine sand and clay fill using HEIC may be up to about 6 m and up to about 7 m, respectively. In some embodiments, the compactor 22 may operate at a relatively high operating speed, such as covering up to about 15,000 $m^2$ per hour per pass of the compactor 22. The present disclosed embodiments may include a single compactor 22, but other embodiments may include multiple compactors 22. Using the present embodiments, the compacted medium 32 may be achieved by the compacting action and/or the work crew.

Figure 4:
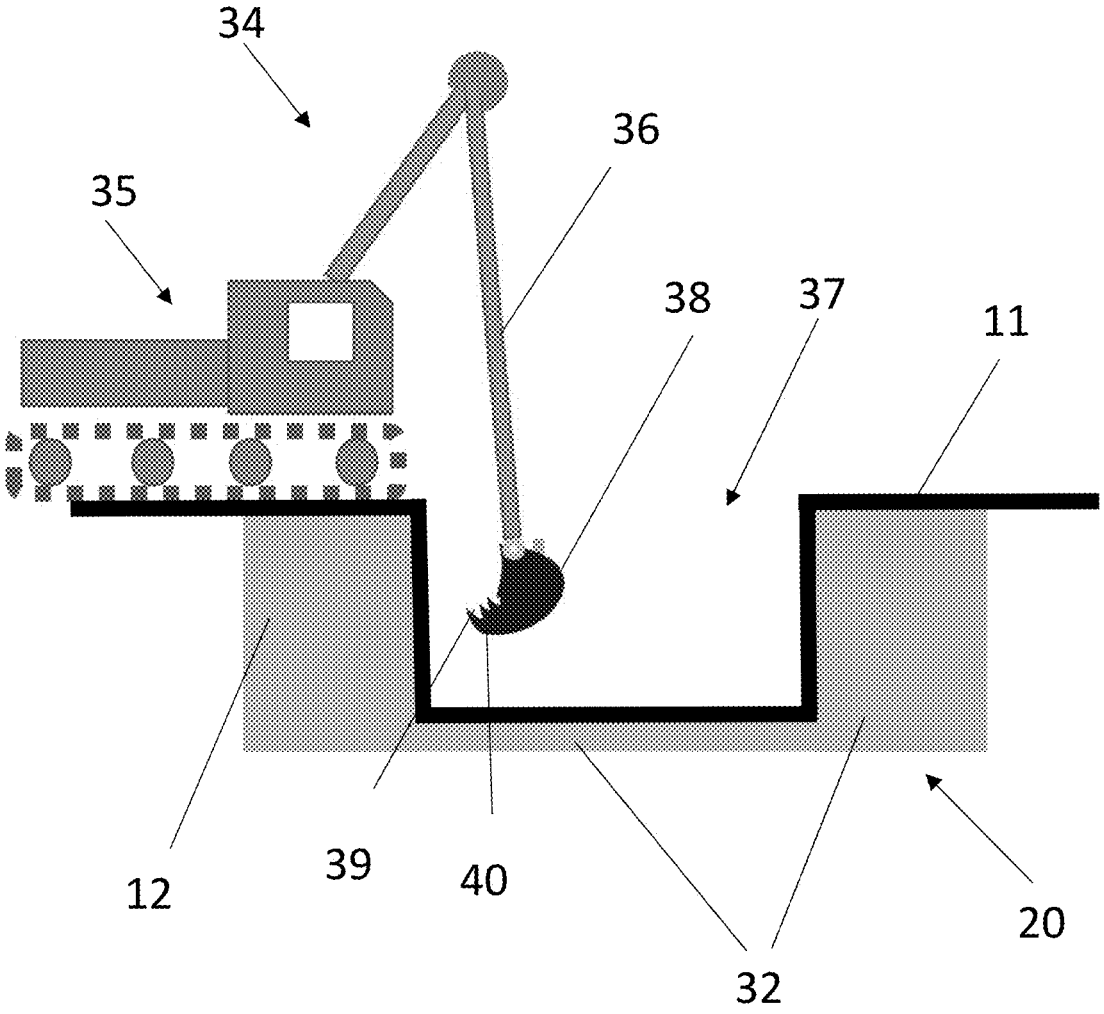
FIG. 4 illustrates a side view of excavation of a construction area, according to aspects of the present embodiments.

FIG. 4 illustrates a side view of excavation of the construction area 20, according to aspects of the present embodiments. An excavator 34 may be disposed on the medium surface 11 to dig the compacted medium 32 out of the construction area 20. The excavator 34 may include a cab 35, an arm 36, and a bucket 38. The distal end of the arm 36 may be operatively coupled to the bucket 38. The bucket 38 may include a side cutter 40 for cleanup, digging, and/or levelling the compacted medium 32. The edge 39 of the side cutter 40 may be straight, wavy (that is, teeth-shape), or a combination of both. The bucket 38 may have different shapes and sizes. Other attachments may also be operatively coupled to the excavator 34 for boring, ripping, crushing, cutting, lifting, and/or other operations at the wellsite. In some embodiment, the excavator 34 may include a tiltrotator (not shown) for the bucket 38 and/or other attachments to rotate 360 degrees and tilt about + or −45 degrees to increase the flexibility and precision of the excavator 34. The present disclosed embodiments may include a single excavator 34, but other embodiments may include multiple excavators 34. Using the present embodiments, excavation may be achieved by the excavating action and/or work crew. After excavation, an excavated area 37 may be slightly wider than the cellar 14.

Figure 5:
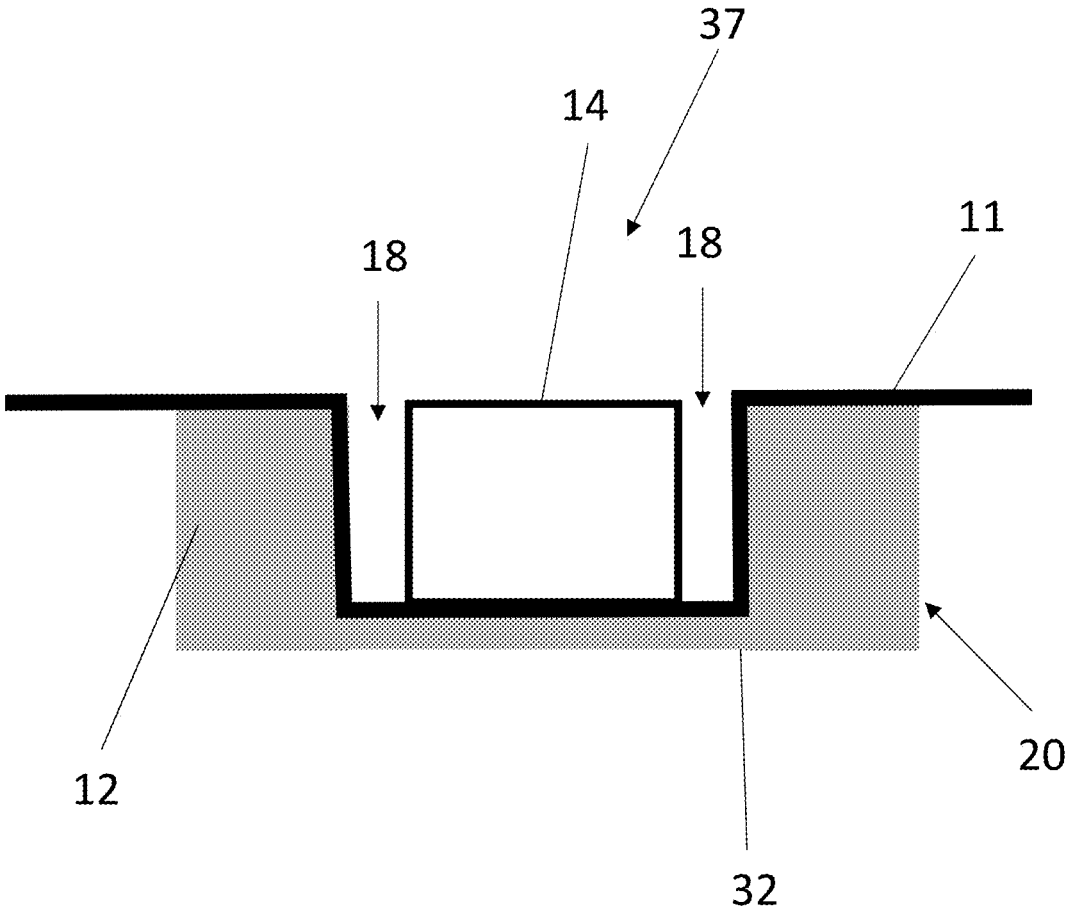
FIG. 5 illustrates a side view of installation of a cellar, according to aspects of the present embodiments.

FIG. 5 illustrates a side view of installation of the cellar 14, according to aspects of the present embodiments. The cellar 14 may be installed near or at the center of the excavated area 37. The cellar 14 may include an open-ended top and bottom for one or more drill pipes to pass through, and to subsequently drill boreholes longitudinally downward below the cellar 14. In the embodiments of FIG. 5, no bottom pads or marl layers (FIG. 2) may be needed. The cellar 14 may be made of steel, aluminum, concrete, reinforced concrete, fiberglass, fiberglass-reinforced plastic, other suitable materials, and/or combinations thereof. The sides and bottom of the cellar 14 may include portions that are composed of crack-resistant materials so that the backfill material may not fill the cellar 14 during and after backfilling, and to prevent damage to the cellar 14.

Referring to FIG. 5, both the cellar 14 and the gap 18 may include geometries that are cuboid, box, cylinder, barrel, bowl, and/or combinations thereof. In some embodiments of FIG. 5, the gap(s) 18 may be significantly, or at least partially, narrower or smaller than the cellar 14. In one embodiment, the cellar 14 may be a box with dimensions of up to about 3.96 m×up to about 6.71 m and/or up to about 4.27 m deep (for example, for gas drilling pads). In another embodiment, the cellar 14 may be a box with dimensions of up to about 5 m in width, up to about 8 m in length, and/or up to about 5 m deep. In another embodiment, the cellar 14 may be a box with dimensions of up to about 6 m in width, up to about 10 m in length, and/or up to about 5.5 m deep. In another embodiment, the cellar 14 may be a box with dimensions of up to about 8 m in width, up to about 12 m in length, and/or up to about 6 m deep. In another embodiment, the cellar 14 may be a barrel with an external diameter of up to about 3 m, a depth of up to about 0.6 m, and/or a thickness of up to about 16 mm (for example, for oil drilling pads). In another embodiment, the cellar 14 may be a barrel with an external diameter of up to about 4 m, a depth of up to about 1 m, and/or a thickness of up to about 20 mm. In another embodiment, the cellar 14 may be a barrel with an external diameter of up to about 5 m, a depth of up to about 2 m, and/or a thickness of up to about 30 mm. In another embodiment, the cellar 14 may be a barrel with an external diameter of up to about 10 m, a depth of up to about 4 m, and/or a thickness of up to about 50 mm.

Referring still to FIG. 5, the cellar 14 may be installed and disposed in the construction area 20 by using installation equipment (for example, trucks, cranes, excavators, skid steers, loaders and/or other installation equipment) and/or work crews. In one embodiment, the top side of the cellar 14 may be lower than the medium surface 11 after installation. In another embodiment, the top side of the cellar 14 may be about as high as the medium surface 11 after installation. In another embodiment, the top side of the cellar 14 may be higher than the medium surface 11 after installation. The present disclosed embodiments may include a single cellar 14, but other embodiments may include multiple cellars 14. Using the present embodiments, installation may be achieved by both the installing action and/or the work crew.

Figure 6:
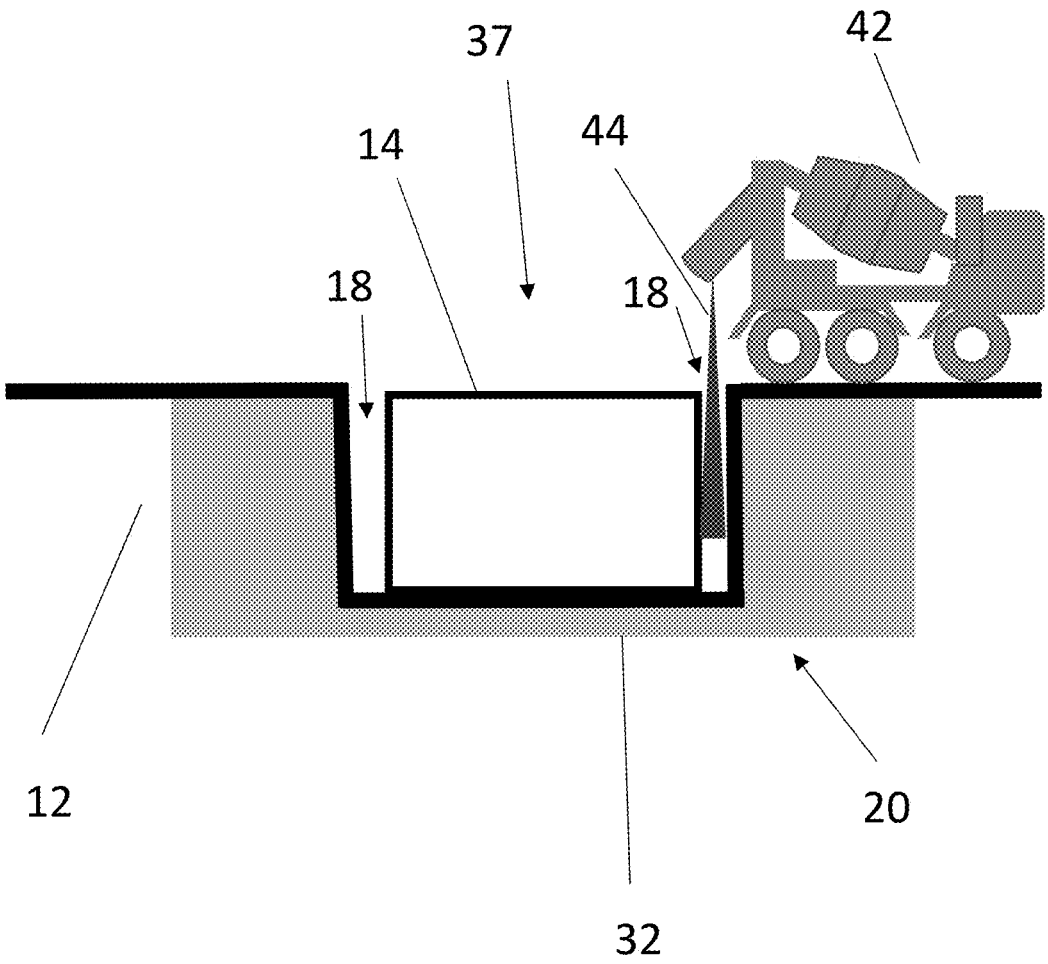
FIG. 6 illustrates a side view of backfilling, according to aspects of the present embodiments.

FIG. 6 illustrates a side view of backfilling the gap 18, according to aspects of the present embodiments. A backfill equipment 42 (for example, a cement mixer truck) may be disposed on the medium surface 11 and may be used to pour a backfill material 44 (preferrably CLSM) into the gap 18. In the present embodiments, the gap 18 may include one or more gaps between the cellar 14 and the compacted medium 32. The use of CLSM as the backfill material 44 may reduce the volume of the gap 18 to about 0.5 m wide. The strength of CLSM may be higher than that of the compacted medium 32 and may consolidate within about 6-8 hours. The present disclosed embodiments may include a single backfill piece of equipment 42, but other embodiments may include multiple backfill machines 42. Using the present embodiments, the cellar 14 may be steadily placed in the excavated area 37 by the backfill equipment 42, the backfill material 44, and/or the work crew.

Referring to FIGS. 3-6, the system and methods may be used to prepare or construct a well pad with reduced time (for example, from about 10 days to up to about 3 days), while also reducing the construction area 20 (for example, from about an area of 25 m×25 m to an area 14 slightly larger than the cellar), dust, and/or traffic at or around the construction site. Watering or layer-by-layer compaction may not be needed.

Figure 7:
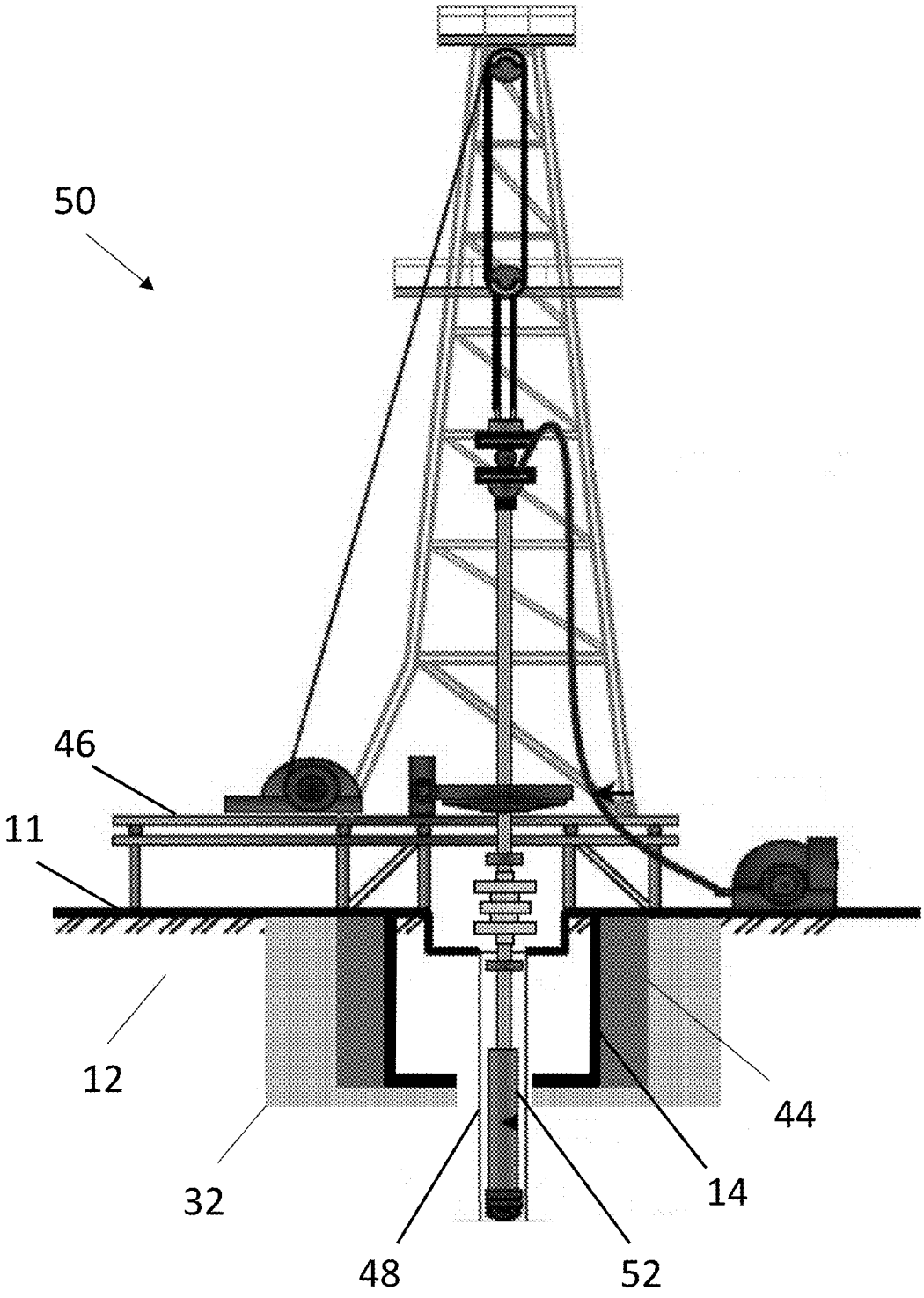
FIG. 7 illustrates a side view of a borehole formed by using a drilling rig longitudinally above the cellar, according to aspects of the present embodiments.

FIG. 7 illustrates a side view of a borehole 48 formed by using a drilling rig 50 longitudinally above the cellar 14, according to aspects of the present embodiments. The drilling rig 50 may be installed on the prepared well pad and may include a rig floor 46. The work crew may work primarily on the rig floor 46 above the medium surface 11 to install a drill pipe 52 through the open end of the cellar 14 and to drill in the borehole 48 within the formation using the drill pipe 52. The present disclosed embodiments may include a single drilling rig 50, but other embodiments may include multiple drilling rigs 50. Using the present embodiments, one or more rig pads or well pads 10 may be constructed.

Figure 8:
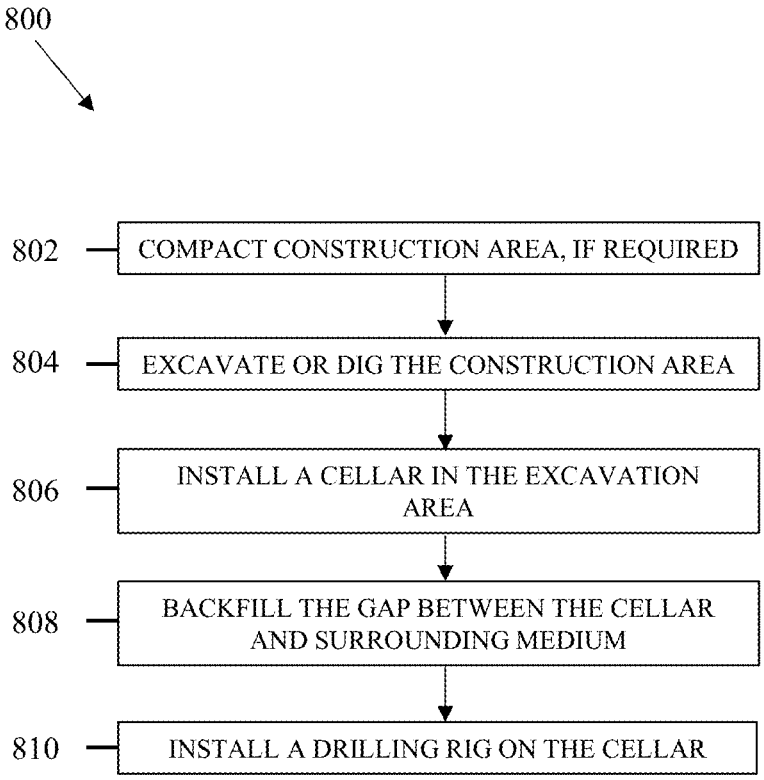
FIG. 8 illustrates a schematic of a method of constructing a well pad, according to aspects of the present embodiments.

FIG. 8 illustrates a schematic of an exemplary method 800 of constructing a well pad for drilling operations, according to aspects of the present embodiments. At step 802, the method 800 may include compacting construction area, if required. In some embodiments, the method 800 may include filling the construction area 20 to a certain level before compacting, and then start step 802. For example, in some embodiments, the construction area may include leveling and/or spreading material from one or more areas of the construction area to other areas(s) such that the construction area is generally flat prior to the initiating compaction operations. At step 804, the method 800 may include excavating or digging the construction area 20 using an excavator 34. At step 806, the method 800 may include installing a cellar 14 in the construction area 20. At step 808, the method 800 may include backfilling the gap 18 between the cellar 14 and surrounding medium (for example, a compacted medium or an uncompacted medium 12) with a backfill material 44 (for example, CLSM). The backfill material 44 may consolidate for a period of time (for example, 1-3 days). At step 810, the method 800 may include installing a drilling rig 50 longitudinally above the cellar 14 for drilling operations. Using the present embodiments, one or more rig pads or well pads 10 may be constructed.

Each of the components described herein may be composed of stainless steel, carbon steel, austenitic steel, metallic alloys, elastomers, aluminum, titanium, concrete, reinforced concrete, fiberglass, fiberglass-reinforced plastic, and other suitable materials commonly used in the oil and gas industries.

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

These and other features, aspects and advantages of the present invention will become better understood with reference to the following description and appended claims. The accompanying drawings, which are incorporated in and constitute a part of this specification, illustrate embodiments of the present disclosure and, together with the description, serve to explain the principles of the present embodiments.

CERTAIN DEFINITIONS

In order for the present disclosure to be more readily understood, certain terms are first defined below. Additional definitions for the following terms and other terms are set forth throughout the specification.

An apparatus, system, or method described herein as "comprising" one or more named elements or steps is open-ended, meaning that the named elements or steps are essential, but other elements or steps may be added within the scope of the apparatus, system, or method. To avoid prolixity, it is also understood that any apparatus, system, or method described as "comprising" (or which "comprises") one or more named elements or steps also describes the corresponding, more limited apparatus system, or method "consisting essentially of" (or which "consists essentially of") the same named elements or steps, meaning that the apparatus, system, or method includes the named essential elements or steps and may also include additional elements or steps that do not materially affect the basic and novel characteristic(s) of the system, apparatus, or method. It is also understood that any apparatus, system, or method described herein as "comprising" or "consisting essentially of" one or more named elements or steps also describes the corresponding, more limited, and closed-ended apparatus, system, or method "consisting of" (or "consists of") the named elements or steps to the exclusion of any other unnamed element or step. In any apparatus, system, or method disclosed herein, known or disclosed equivalents of any named essential element or step may be substituted for that element or step.

As used herein, the term "controlled low-strength material" or "CLSM" generally refers to a self-compacted, cementitious material primarily used for backfilling. CLSM may be superior for achieving a uniform density, when compared to conventional backfill materials. It may have a compressive strength of up to about 8.3 MPa (1200 psi) and may be typically composed of water, cement, fine aggregates such as sands, crushed stones, or other suitable fine particles (with most particles smaller than 4.75 mm or less than about 6.35 mm and larger than about 0.074 mm in diameter and/or largest dimension), and byproduct materials (for example, ash and quarry dust). CLSM may be also termed flowable fill or soil-cement slurry. The expected strength of CLSM used in the present disclosure may be up to about 8.3 MPa (1200 psi). CLSM may be used in conditions where space limitations, limited accessibility, unsafe access, critical construction factors, and/or time limitations exist. CLSM may be readily placed into trenches without the need for compaction or special curing procedures. In addition, deep trenches may be filled in using CLSM.

As used herein, the term "compaction", "compacting", or "compact" may be used to describe a process of pressing grains in a medium together to consolidate the medium, resulting in the reduction of pore space, pore fluids, and formation of rock, and also resulting in an increase in the bulk density of the medium. A "compactor" may be used to describe a machine used to drive over a medium to reduce the size or the volume of the medium. It may be powered by hydraulics, and may include various shapes and sizes.

As used herein, the term "medium" or "media" may be used to describe the material(s) commonly used in the oil and gas industry (as well as other industries, for example, for use in the construction of water wells and the construction industry) where the well pad is constructed, such as soil, sands, and/or rocks.

As used herein, the term "high energy impact compaction" or "HEIC" generally refers to a repeated systematic application of high energy for compaction by using a heavy non-cylindrical drum or impact roller attached to equipment or machinery to achieve the required compaction. HEIC may be used for constructing industrial slabs-on-ground, footings for industrial column loadings, or subgrades for supporting heavy weight traffic. The equipment or machine may come in different sizes and shapes for constructing different levels of compaction.

As used herein, the term "drum" or "impact roller" may vary in weight, shape, compaction coverage, and drop height, resulting in a variation in the specific energy input and consequently the depth of influence and the magnitude of increase in the in-situ medium strength.

As used herein, the term "well pad", "drilling pad", or "construction area" may be used to describe a drilling site, or component thereof at least partially constructed of local materials.

As used herein, the term "cellar" may be used to describe a cavity or box that is inserted in an excavated area, possibly lined with wood, cement, or thin-wall pipe with a large diameter (for example, about 1.8 m), located below the drilling rig. The cellar may serve as a cavity in which the casing spool and casing head reside. The cellar may include an open-ended top and bottom through which a drill pipe may pass and drill a borehole below the cellar. Prior to setting of the surface casing, the cellar may also take mud that may return from the well, which may be pumped back to the surface equipment.

As used herein, the term "substantially" refers to the qualitative condition of exhibiting total or near-total extent or degree of a characteristic or property of interest.

As used herein, "a" or "an" with reference to a claim feature means "one or more," or "at least one."

EQUIVALENTS

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A well pad construction system comprising:

a construction area;

an excavator disposed at the construction area, the excavator moveable over the construction area to generate an excavated area;

a cellar disposed within the excavated area;

controlled low-strength material (CLSM);

backfill equipment disposed around the excavated area at the construction area, the backfill equipment moveable to pour CLSM into a gap between the cellar and surrounding medium in the excavated area for holding the cellar in place; and a compactor disposed at the construction area, where the compactor is moveable over the construction area, the compactor comprising an impact roller for compacting the excavated area prior to excavation, where the compactor applies high energy impact compaction (HEIC) at the construction area.

2. The system of claim 1, where the impact roller comprises a non-cylindrical impact roller with three rounded lobes connected by three joints, each rounded lobe comprising from about 120° to about 180° of a cylinder.

3. The system of claim 1, where the CLSM comprises water, cement, and fine aggregates.

4. The system of claim 1, where the CLSM comprises byproduct materials.

5. The system of claim 1, where the expected maximum strength of the CLSM is about 8.3 MPa (1200 psi).

6. The system of claim 1, where the cellar is composed of at least one of steel, aluminum, concrete, reinforced concrete, fiberglass, and fiberglass-reinforced plastic.

7. The system of claim 1, where the cellar comprises a shape of at least one of a cuboid, a box, a cylinder, a barrel, a bowl, and combinations thereof.

8. The system of claim 1, where the sides and bottom of the cellar comprise a crack-resistant material.

9. The system of claim 1, where the top and the bottom of the cellar are at least partially open.

10. The system of claim 1, further comprising:

a drilling rig disposed longitudinally above the cellar; and a drill pipe disposed longitudinally below the drilling rig, the drill pipe passing through the top and the bottom of the cellar for drilling a borehole downward below the cellar.

11. A method of preparing a well pad comprising:

identifying a construction area;

compacting the construction area to generate a compacted medium within the construction area;

excavating the compacted medium using an excavator, where excavating the compacted medium creates an excavated area within the compacted medium;

installing a cellar in the excavated area; and backfilling a gap between the cellar and surrounding medium with a backfill material, where compacting the construction area selectively uses high energy impact compaction (HEIC) using an impact roller, and where the impact roller comprises a non-cylindrical impact roller with three rounded lobes connected by three joints, each rounded lobe comprising from about 120° to about 180° of a cylinder.

12. The method of claim 11, where the backfill material comprises controlled low-strength material (CLSM).

13. The method of claim 11, where the gap between the cellar and the surrounding medium is up to about 0.5 m wide.

14. The method of claim 11, where the cellar is disposed near or at the center of the excavated area.

15. The method of claim 11, where installing the cellar in the excavated area comprises using at least one of trucks, cranes, excavators, skid steers, and loaders.

16. The method of claim 11, further comprising installing at least one drilling rig at the construction area, the at least one drilling rig disposed longitudinally above the cellar.

17. The method of claim 11, where preparing the well pad takes up to about 3 days.

18. A drilling site comprising:

a compacted medium comprising an excavated area;

a cellar disposed within the excavated area;

backfill material disposed between the cellar and the compacted medium, where the backfill material comprises controlled low-strength material (CLSM);

a compactor disposed at the drilling site, where the compactor is moveable over the excavated area, the compactor comprising an impact roller for compacting the excavated area prior to excavation, and where the compactor applies high energy impact compaction (HEIC) at the drilling site;

a drilling rig disposed longitudinally above the cellar; and a drill pipe disposed longitudinally below the drilling rig, the drill pipe passing through the top and the bottom of the cellar for drilling a borehole downward below the cellar.

19. The site of claim 18, where the cellar comprises a bowl shape.

20. The site of claim 18, where a volume of excavation required for rig pad preparation is reduced by at least 80%.

21. The site of claim 18, where additional soil is not required for use as the backfill material.

22. The site of claim 18, where the backfill material consists of CLSM.

23. The site of claim 18, where the backfill material provides a firm well pad for the drilling rig to stand on and operate from.

24. The site of claim 18, where the impact roller comprises a non-cylindrical impact roller with three rounded lobes connected by three joints, each rounded lobe comprising from about 1200 to about 1800 of a cylinder.

25. The site of claim 18, where the CLSM comprises water, cement, fine aggregates, and byproduct materials, and where the CLSM comprises a maximum strength of about 8.3 MPa (1200 psi).

26. The site of claim 25, where the fine aggregates comprise at least one of sand and crushed stones, and where the fine aggregates comprise a diameter or largest dimension that is larger than about 0.074 mm and smaller than about 6.35 mm.

* * * * *